United States Patent [19]

Tanaka et al.

[11] Patent Number: 4,543,001

[45] Date of Patent: Sep. 24, 1985

[54] SERIAL PRINTER WITH DOT MATRIX TYPE PRINT HEAD

[75] Inventors: Hideyo Tanaka, Seto; Mineo Harada, Owariasahi, both of Japan

[73] Assignee: Hitachi, Ltd., Tokyo, Japan

[21] Appl. No.: 463,653

[22] Filed: Feb. 3, 1983

[30] Foreign Application Priority Data

Feb. 16, 1982 [JP] Japan ..... 57-23257

[51] Int. Cl.[4] ..... B41J 33/04; B41J 35/14

[52] U.S. Cl. ..... 400/212; 400/216.1; 400/224; 400/240.4

[58] Field of Search ..... 400/240.4, 124, 126, 400/120, 212, 224, 216, 216.1, 216.2, 216.3

[56] References Cited

U.S. PATENT DOCUMENTS

| | | | |
|---|---|---|---|
| 4,378,566 | 3/1983 | Tsukamura | 400/240.4 X |
| 4,403,874 | 9/1983 | Payne et al. | 400/124 |
| 4,407,595 | 10/1983 | Gershnow | 400/240.4 X |
| 4,425,046 | 1/1984 | Van Horne et al. | 400/212 X |

OTHER PUBLICATIONS

*IBM Tech. Disc. Bulletin*, by E. T. Osborne, vol. 18, No. 5, Oct. 1975, p. 1313, 400-126.

*Primary Examiner*—Paul T. Sewell

*Attorney, Agent, or Firm*—Antonelli, Terry & Wands

[57] ABSTRACT

A dot matrix type serial printer wherein a print medium is printed with indicia such as letters, characters, symbols, or the like by selectively driving a number of print elements while moving a print head having the print elements in a direction of a printing line. To enable the simultaneous printing of a number of print lines in different colors, an ink ribbon is provided having a plurality of tracks in the different colors. The print head includes groups of print elements which are arranged such that the respective groups face and are associated with the respective different tracks of the ink ribbon thereby enabling the simultaneous printing of a number of print lines in the different colors by moving the print head. The ink ribbon is adjustable from a first mode wherein the print elements simultaneously print lines of different colors, to a second mode wherein all of the print elements may be associated with a common track of the ink ribbon thereby enabling a simultaneous printing of print lines in a single color.

12 Claims, 14 Drawing Figures

SERIAL PRINTER WITH DOT MATRIX TYPE PRINT HEAD

The present invention relates to a printer arrangement and, more particularly, to a serial printer with a dot matrix type print head for enabling a printing of a print medium by selectively driving dot-print elements, overlying a print head, while moving the print head in a direction of a printing line.

By virtue of the colors of CRT's displays, it has been necessary to develop a colored printer so as to enable a making of a hard copy in colors corresponding to the colors of the CRT display and, for this purpose, wire dot matrix type printers and ink jet type printers have been proposed which are of the impact type and non-impact type, respectively.

In proposed wire dot matrix type color printers, the color serial printer is provided with an ink ribbon having tracks of two colors, for example, red and black, with the serial printer generally using a black travel for printing purposes so that the tracks of the ink ribbon may be shifted, when necessary, for enabling an interchange from black to red by the action of a conventional track interchanging mechanism whereby the red track is then used for printing operation while the print head is being moved.

Moreover, recently, it has also been proposed to provide a color serial printer in which an ink ribbon having three tracks in, for example, yellow, magenta, and cyanic colors, is arranged in parallel with a moving direction of the print head, that is, in a direction of a printing line. More particularly, in such proposed construction, the ink ribbon is so shifted and set at first that the yellow track may be positioned in front of the print head and the print head is then moved so that one line may be printed in yellow with letters or the like. After that, the ink ribbon is then shifted so that the magenta track may be positioned in front of the print head, and the print head is likewise moved so that a particular line may be printed in magenta. In this manner, the identical line can be printed with letters or the like in the three colors. If the mixed colors of these three colors are to be counted it is possible then for a color printing to be carried out or conducted in a total of seven colors.

Advantages of the above described proposed serial printers reside in the fact that the contruction of the printers can be achieved by improving a relatively simple printer mechanism; however, a disadvantage of the proposed serial printers resides in the fact that the printing speed is reduced the more one of the printing lines has more indicia such as, for example, letters or pictures, which must be printed in different colors.

More paticularly, as noted above, in case each of the printing lines is a portion to be printed in the three colors, the ink ribbon has to be shifted to have its tracks interchanged into the yellow track before the print head is made to run, and the ink ribbon is then shifted for the printing operation to have its tracks sequentially interchanged into the magenta and cyanic colors. Thus, if, for example, one line is to be printed in three colors, the print head has to be shifted three times for each line so that it takes a time period three times longer than the case in which the printing operation is conducted in only a single color.

It has also been proposed to provide a color printer with a dot matrix type print head wherein the serial printer includes a plurality of print heads carried on a carrier which is adapted to be moved in a direction of a printing line, with the printing heads being juxtaposed independently of one another in the line direction so that a print medium may be printed with letters of the like through ink ribbons of different colors.

In accordance with the last mentioned serial printer, the identical line is printed with the letters or the like simultaneously in plural colors if the carrier is moved along that line so that even the color printing can be accomplished similarily to the mono-color printing in a manner different from the aforementioned proposed color printers thereby raising the color printing speed to a remarkable level. However, a disadvantage of this last mentioned serial printer resides in the fact that, since plural print heads are juxtaposed in a line direction on the identical carrier, the length of the carrier is enlarged in the line direction so that its movement becomes considerably larger than the width of the print medium. This inevitably enlarges the widthwise size of the printer thereby increasing the number of overall parts as well as the mounting space required for accommodating the printer.

The aim underlying the present invention essentially resides in providing a serial printer with a matrix type print head of a wire dot, heat sensitive, or ink jet type which ensures an increase in the speed of a color printing operation.

In accordance with the present invention, a serial printer is provided which includes a matrix type print head for printing, and a print medium, for example, letters, pictures, or symbols which are composed or formed by a combination of dots. For this purpose, driving print elements are selectively driven while a print head, having the print elements thereon, are moved in a direction of a printing line. The print elements, in accordance with the present invention, are grouped into a plurality of groups, with the print head being arranged so that a plurality of groups face a plurality of serial printing lines. Thus, if the print head is moved in a printing line direction, plural lines can be simultaneously printed. Moreover, if the respective groups are to be printed in different colors, plural lines can be simultaneously printed in different colors.

The principles of the color serial printer having a matrix type print head according to the present invention may readily be applied to conventional wire matrix type printers, ink jet type printers, and transfer type thermal printers, and so on. With a wire matrix type printer or a thermal printer, an ink ribbon is provided having a plurality of tracks, with the respective tracks being of different colors.

Preferably, in accordance with the color serial printer of the present invention, a matrix type print head includes a cassette for accommodating the multi colored multi-track ribbon therein with the cassette and a cassette rotating mechanism being carried on a carrier which additionally carries the print head. By virtue of the provision of the rotating mechanism, the respective tracks of the ink ribbon may rotationally be positioned in front of only one group of the print elements and, with the ribbon being so positioned in front of the print elements, if the carrier is displaced, plural lines may be simultaneously printed with the letters, symbols, characters, or the like in the respective lines being printed in different colors.

If the above noted printing operation is conducted while the print medium is sequentially feed line-by-line, the plural lines can be finally printed in the mixed colors of the different colors, respectively, at the time when the print medium is fed by the plural lines for the printing purpose. Therefore, with this construction, the printing operation can be conducted at the same speed as that in the case of a mono-color printing operation even if the plural colors coexist in the identical line.

According to the present invention, the overall printing speed can be further improved in the mono color printing case. More particularly, by virtue of the provision of a rotationally positionable ink ribbon, by an action of the rotating mechanism, a certain color track of the ink ribbon includes plural groups of print elements. Consequently, plural lines can be simultaneously printed in the identical color if the printing operation is conducted in a manner similar to that described above and, as a result, the printing speed in a mono color printing operation can also be raised a number of times.

Accordingly, it is an object of the present invention is provide a serial printer with a matrix type print head which enables the carrying out of a color printing operating at a relatively high speed.

Yet another object of the present invention resides in providing a serial printer with a matrix type print head which is relatively simple in construction and which has an overall relatively small size.

Yet another object of the present invention resides in providing a color serial printer with a matrix type print head which is capable of simultaneously printing a plurality of lines in either identical or in different colors.

A still further object of the present invention resides in providing a serial printer with a matrix type print head which is capable of carrying out a color printing operation with a single print head.

These and other objects, features, and advantages of the present invention will become more apparent from the following describion when taken in connection with the accompanying drawings which show, for the purpose of illustration only, several embodiments in accordance with the present invention, and wherein.

Figure 1:
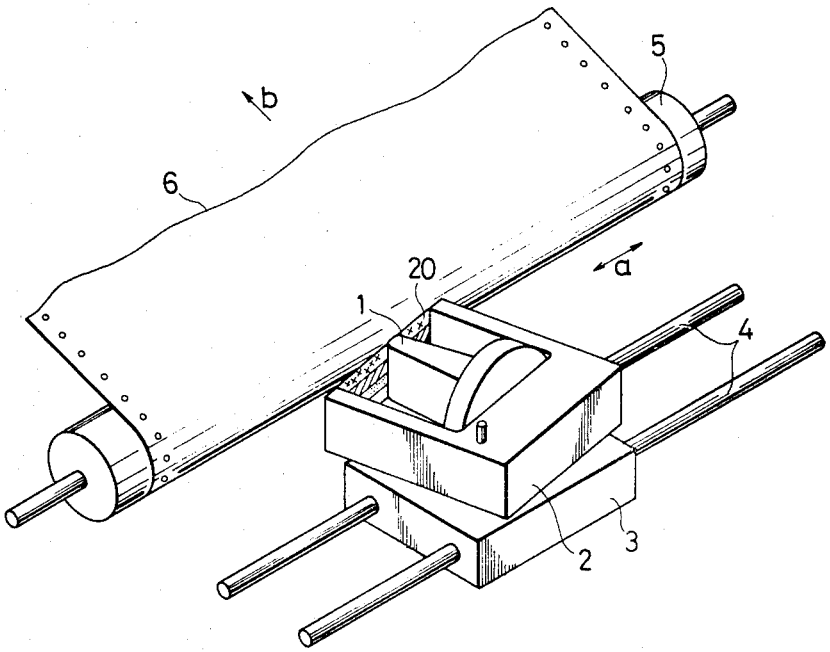
FIG. 1 is a perspective view of a wire dot matrix type serial printer constructed in accordance with a first embodiment of the present invention.

Referring now to the drawings wherein like reference numerals are used throughout the various views to designate like parts and, more particularly, to FIG. 1, according to this figure, a serial printer, having a wire matrix type print head generally designated by the reference numeral 1, includes a carrier 3 having mounted thereon a ribbon cassette 2. The carrier 3 is adapted to be displaced or driven by, for example, a pulse motor or the like (not shown) through a conventional wire rope, timing belt, or the like (not shown) so as to be moved in a direction of the double headed arrow a while being guided by a pair of support rails arranged in parallel to a platen 5. Paper 6 to be printed is fed line-by-line in a direction of the arrow b while being guided on a surface of the platen 5 by, for example, a conventional sprocket type paper-feed mechanism.

In addition to the ink ribbon cassette 2, the print head 1 is also mounted on the carrier 3. In this connection, the significance of the present invention resides in the features realized by both the constructions of the print head 1 and the color ink ribbon 20 accommodated in the ink ribbon cassette and, although the print head 1 resembles proposed matrix type print heads, the significance of the print head 1 of the present invention resides in the disposition and arrangement of the wires or elements acting to form the dot print pattern.

Figure 2:
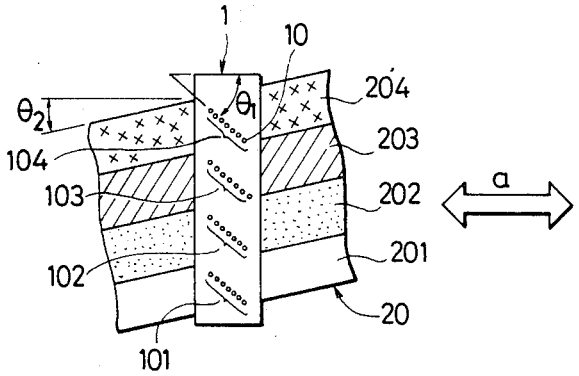
FIG. 2 is a partial detailed view, on an enlarged scale, of a print head and an ink ribbon of the printer of FIG. 1.

More particularly, as shown in FIG. 2, the print head 1 includes, for example, four groups of wire rows 101, 102, 103, 104, with the rows being arranged vertically in a column at a front portion of the print head 1. Each of the wire rows 101–104 includes a predetermined number of wires corresponding to a desired width of one print line and, for example, in the embodiment of FIG. 2, the wire rows 101–104 are each provided with seven wires 10 to correspond to a width of one printing line. The respective wire rows 101–104 are arranged on the printed head 1 so as to be inclined at a predetermined angle $\theta_1$, where $\theta_1>0$, with respect to the moving direction a of the carrier 3.

The ink ribbon 20 is advanced and guided so as to run forwardly of the print head 1 by action of the ink ribbon cassette, with such advancing operation of the ink ribbon 20 being controlled, in a conventional manner, by a control mechanism (not shown).

As shown in FIG. 2, the ink ribbon 20 is a multi-color and multi-track ribbon and includes black, red, blue, and yellow tracks 201, 202, 203, 204, respectively. The ink ribbon cassette 2 is mounted or carried on the carrier 3 in such a manner so as to be inclined at a predetermined angle $\theta_2$, where $\theta_2>0$, with respect to the moving direction a of the print head 1 or carrier 3. In otherwords, the ink ribbon 20 is inclined at an angle $\theta_2$ with respect to the moving direction a. Advantageously, the angle $\theta_2$ is preferably set at such a value that the track of a certain color such as, for example, the black track 201, does not interfere with the adjoining wire row 102 whereby the maximum width of each track 201–204 may be utilized by the corresponding wire row 101–104.

For example, with $\theta_1\theta_2$=to 90°, the arranging direction of the wires 10 and lengthwise direction, i.e., feeding direction, of the ink ribbon 20 intersect at a right angle and the respective wire rows 101–104 are guided or extend fully over the width of the respective tracks 201–204 of the ink ribbon 20 so that the efficient use of the ink ribbon is maximized.

With the construction thus far described, if the wires 10 of the respective wire rows 101–104 are selectively driven while the carrier 3 is moved or displaced, an impact force is applied through the ink ribbon 20 to the paper 6 so that the paper 6 is printed with letters, symbols, pictures, or the like which are composed or formed of a combination of dots in the four colors. By virture of the features of the embodiment of FIGS. 1 and 2, up to four lines can be simultaneously printed in the different colors by a single movement or displacement of the carrier 3; therefore, it is possible to carry out a color printing operation at a higher speed than in previously proposed color printers. Moreover, since a width size of the print head 1 of the present invention can be similar to that of a conventional mono-color printing apparatus, it is unnecessary to enlarge the size of the color printer of the present invention so as to be larger than that of conventional color printers. Furthermore, by virtue of the provision of the ribbon cassette 2 and the mounting thereof on the carrier along with the print head, it is possible to dispense with the need for complicated ribbon interchanging mechanisms such as employed in conventional color printers. Additionally, the wires 10 and ink ribbon 20 can be prevented from being blotted even when the tracks 201–204 of the ink ribbon 20 are changed from one to another color.

Figure 3:
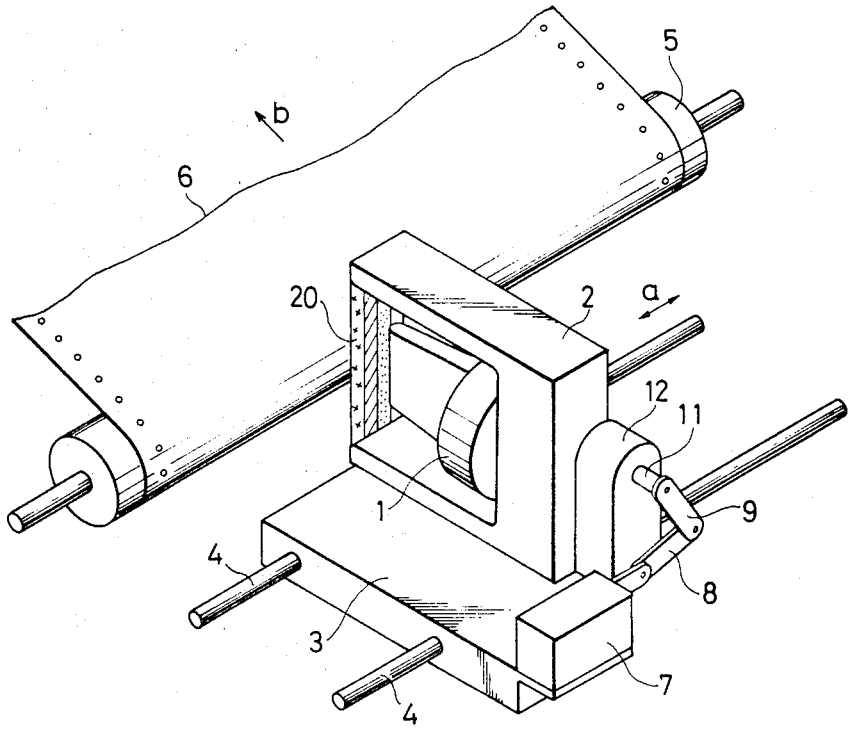
FIG. 3 is a perspective view of another embodiment of a wire dot matrix type serial printer constructed in accordance with the present invention.

FIG. 3 provides an example of a means for rotating the ink ribbon cassette 2 and, according to this Figure, a shaft 11 is fixed to a rear portion of the ribbon cassette 2, with the shaft 11 being rotatably mounted on the carrier 3 by means of, for example, a support 12. The shaft 11 includes a leading end fixed to one end of an arm 9, with an opposite end of the arm 9 being rotatably joined to one end of a link 8. An opposite end of the link 8 is rotatably connected to a ribbon cassette operator or actuator in the form of, for example, an electromagnet 7. In all other respects the arrangement of the wires 10 of the print head 1 and construction of the tracks 201–204 of the ink ribbon 20 in the construction of FIG. 3 are similar to that shown in FIG. 2.

If, in the embodiment of FIG. 3, a printing operation is to be only carried out in the black, the magnet 7 is operated and held at a retracted position so that the ink ribbon cassette 2 then assumes the position illustrated in FIG. 3. At this time, the black track 201 of the ink ribbon 20 is positioned in front of all of the wire rows 104 of the print head 1 and, as a result, as shown most clearly in FIG. 4, the four lines can be simultaneously printed in the black color from the black track 201 while the carrier 3 is being moved one stroke from left to right or from right to left. This means that the printing speed can be substantially raised to be at least four times as high as that of a conventional serial printer which conducts a printing operation by the use of a print head having rows of dots for one line. Since there are so many applications in which the printing operation is to be conducted only in one color such as, for example, in a black color, the effects and advantages stemming from the construction of the embodiment of FIG. 3 is markedly high.

Figure 4:
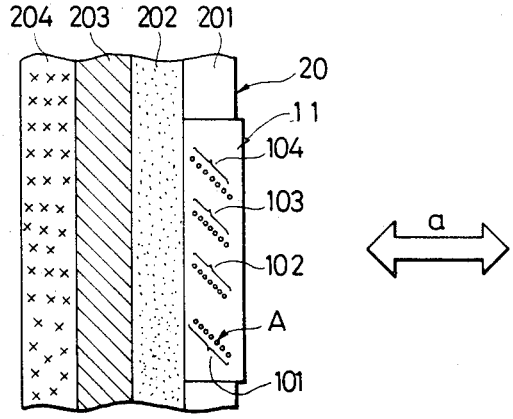
FIG. 4 is a detail view, on an enlarged scale, of a print head and ink ribbon of the printer of FIG. 3.
Figure 5:
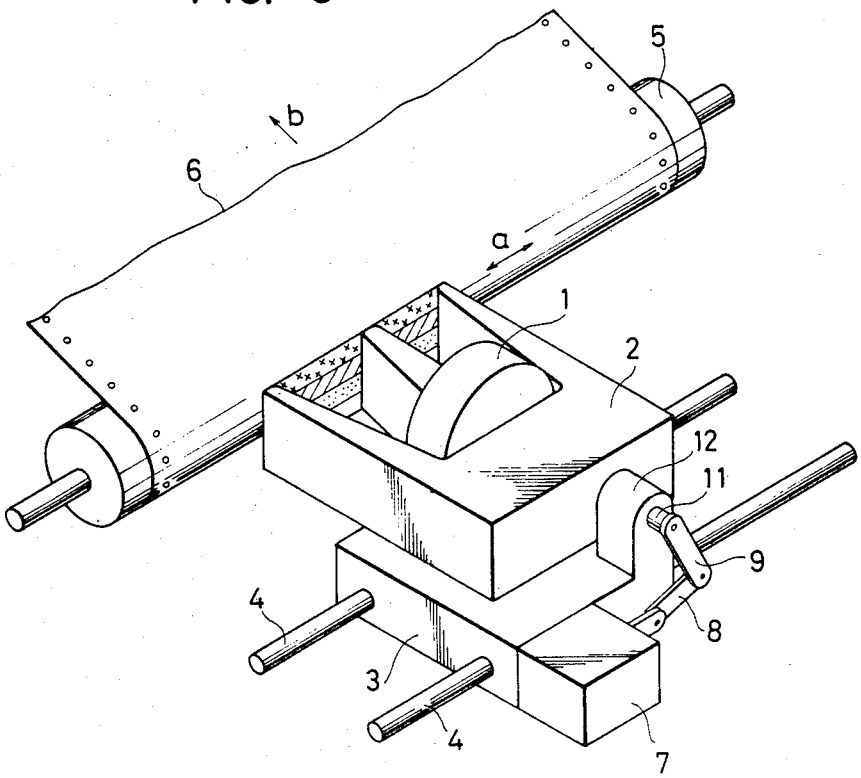
FIG. 5 is a perspective view of the serial printer of FIG. 3 illustrating elements thereof in a state for a color printing operation.

On the other hand, in a color printing operation, as shown most clearly in FIG. 5, the ink ribbon cassette 2 is rotated by the shaft 11 by virtue of the operation of the magnet 7 so as to advance the operating or actuator portion thereof until the ink ribbon cassette 2 assumes a generally horizontal position. At this time, the respective wire rows 101, 102, 103, and 104 and corresponding tracks 201, 202, 203, and 204 are so arranged so as to assume the position illustrated in FIG. 2. In this connection, it is noted that a center of rotation of the ink ribbon 20 is disposed at a position designated A in FIG. 4, that is, at a center of the wire row 101. Moreover, a printing operation in the state illustrated in FIGS. 3 and 4 is absolutely the same as described hereinabove in connection with the embodiment of FIGS. 1 and 2.

The drive source for rotating the ink ribbon cassette 2 may either be in the form of a motor or an electromagnetic clutch and, for example, the transmission from the drive source to the shaft may, for example be in the form of a gear mechanism (not shown) rather than a link mechanism. It is also possible in accordance with the present invention in a manner not shown in the drawings, to provide a direct connection of the drive source and ink ribbon cassette 2.

Figure 6:
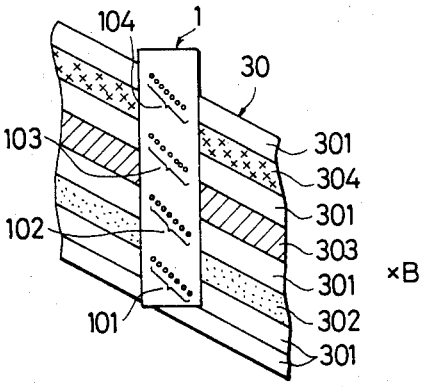
FIG. 6 is a detail view, on an enlarged scale, of a futher embodiment of a serial printer constructed in accordance with the present invention showing a relationship between the print head and ribbon.
Figure 7:
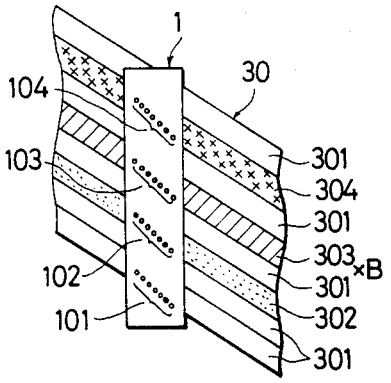
FIG. 7 is a detail view, on an enlarged scale, of the embodiment of FIG. 7 with the ribbon being in a rotated position.

FIGS. 6 and 7 provide an example of a further embodiment of the present invention employing an ink ribbon generally designated by the reference numeral 30 having, for example, a total of eight tracks, wherein black tracks 301 are respectively added adjacent to the tracks of the four colors. More particularly, as shown in FIGS. 6 and 7, in addition to a black, red, blue, and yellow track, 301, 302, 303, 304, respectively, the ink ribbon 30 is provided with additional black tracks 301 disposed adjacent to the tracks 301, 302, 303, and 304, with the ink ribbon 30 being adapted to be rotated about the point B in FIGS. 6 and 7.

As shown most clearly in FIG. 6, when the ink ribbon 30 is rotated so as to assume the illustrated position, the added black tracks 301 are positioned in front of the respective wire rows 101–104 and, consequently, the four lines can be simultaneously printed in the black color. With the ink ribbon 30 being rotated to the position shown in FIG. 7, the black, red, blue, and yellow tracks 301, 302, 303 and 304 are respectively positioned in front of the wire rows 101, 102, 103, and 104 so that the four lines can be simultaneously printed in the respective colors. A significant feature of the embodiment of FIGS. 6 and 7 resides in the fact that a rotation of the ink ribbon cassette (not shown) accommodating the ink ribbon 30 can be relatively small.

Figure 8:
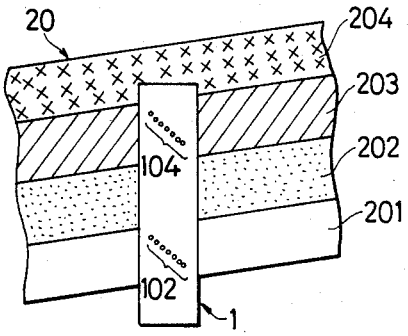
FIG. 8 is a detail view, on an enlarged scale, of yet another embodiment of a serial printer constructed in accordance with the present invention showing a further relationship between a print head and ribbon.
Figure 9:
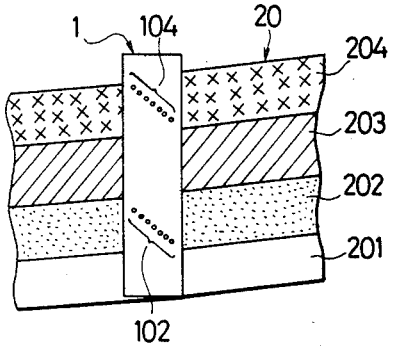
FIG. 9 is a detail view, on an enlarged scale, of the position of the print head and ribbon of the embodiment in FIG. 8 with the ribbon rotated.

FIGS. 8 and 9 provide an example wherein wire rows of the print head are reduced to, for example, two in number. More particularly, the print head 1 is provided with two wire rows 102, 104 and, in all other respects, the construction of FIG. 8 is similar to the embodiment illustrated in FIG. 3; however, a center of rotation of the ink ribbon 20 is located at a point or position (not shown) which is relatively distant from the print head 1.

If the ink ribbon 20 is positioned as shown in FIG. 8, the black track 201 and blue track 203 are positioned in front of the wire rows 102 and 104 so that two rows, one in black and one in blue may be simultaneously printed. If the ink ribbon 20 is slightly rotated counterclockwise to the position illustrated in FIG. 9, the red track 202 and the yellow track 204 are brought in front of the wire rows 102 and 104 so that the two lines can be simultaneously printed in the red and yellow colors, respectively.

In the embodiment of FIGS. 8 and 9, the color printing operation may be conducted at a speed twice as high as that of conventional color printers.

Figure 10:
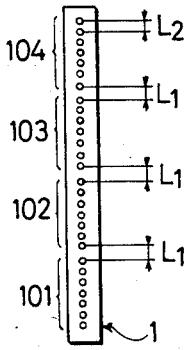
FIGS. 10 and 11 are partially schematic views of print heads constructed in accordance with the present invention illustrating a vertical spacing between print elements.
Figure 11:
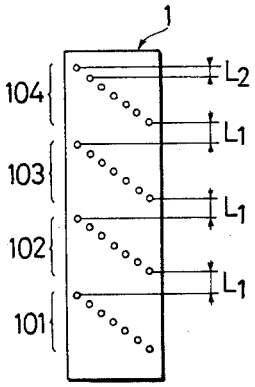

For graphic printing operation, it is advantageous if, in the above described embodiments, the vertical gap between the dot print elements in each row and vertical gap between the adjacent dot print element rows are equalized. In this connection, with regard to the print head 1 of FIGS. 3–7, gaps $L_1$ and $L_2$ are selected to be at an equal value as shown in FIGS. 10 or 11. With the arrangement, the vertical gaps between all of the print elements are constant so no irregularly coarse portions, that is, gaps between the printing lines, can take place in situations wherein a display frame of a color display system is to be graphically printed as a hard copy.

Figure 12:
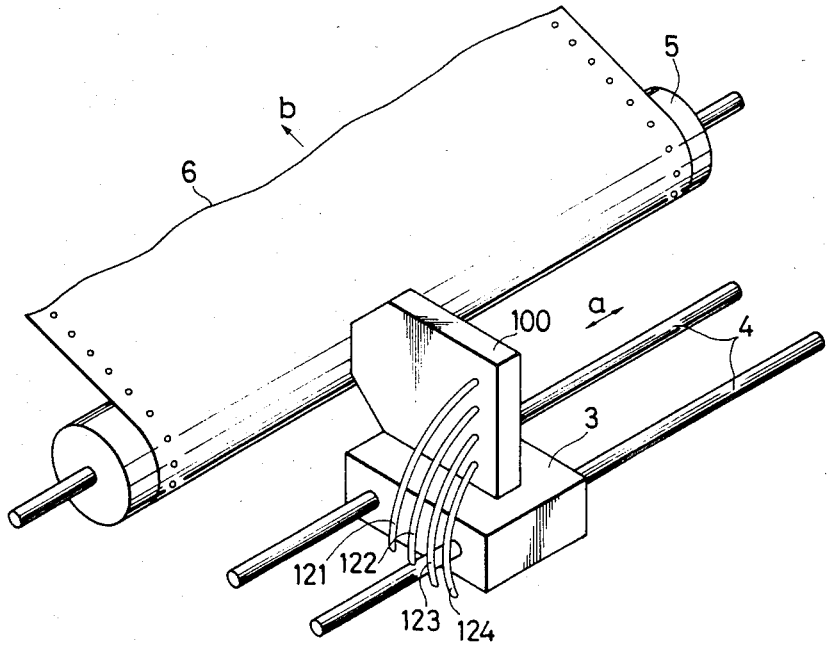
FIG. 12 is a perspective view of another embodiment of a color serial printer constructed in accordance with the present invention as an ink jet printer.
Figure 13:
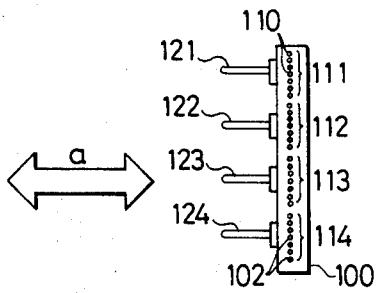
FIG. 13 is a detail view, on an enlarged scale, of a printing head of the printer in FIG. 12.

The arrangement of the dot print elements in the respective rows on the print head 1 need not be limited to the arrangement described hereinabove and, for example, the print elements may take the form of nozzles of an ink jet type print head. In this connection, FIG. 12 provides an example of the principles of the present invention applied to an ink jet type serial printer. More particularly, as shown in FIGS. 12 and 13, a print head 100, similar to conventional ink jet print heads having a variable capacity for injecting ink droplets but differing from conventional ink jet print heads by virtue of the arrangement of the dot print elements, that is, ink jet nozzles 100, includes nozzle rows 111, 112, 113, 114 arranged in a vertical direction intersecting the row direction at a right angle on a front side of the print head 100. Each nozzle row 111, 112, 113, 114 includes a plurality of nozzles 110 corresponding to a width of one print line and, for example, in the illustrated embodiment of FIGS. 12 and 13, the print head 100 includes seven nozzles 110. The respective nozzles 110 of the nozzle rows 111, 112, 113, 114, are supplied with ink in different colors from suitable ink supply sources (not shown) by way of conduits or lines 121, 122, 123, 124, respectively.

If the nozzles 110 of the respective rows 111, 112, 113, 114 are selectively actuated or driven in a conventional manner while the carrier 3 is moved, ink droplets are injected from the actuated or driven nozzles 110 to impinge upon the paper 6 so that the paper 6 is printed with the four color letters, symbols, pictures, or the like which are composed or formed by a combination of the ink droplet dots. In FIGS. 12 and 13, the four lines can be simultaneously printed in the respective colors merely by moving the carrier 3 once from left to right or vice versa. For a line having two or more colors mixed, the printing operation is repeated for the respective colors while a new line is being made for the paper 6. However, if it is desired to print continuous lines, even the line having four colors mixed can be printed at a speed of one line for the one stroke of the carrier 3. Therefore, if the printing speed for each dot is assumed to be equal, the embodiment of FIGS. 12 and 13 realizes a printing speed of four times as high as that of a conventional printer and, as can well be appreciated, the printing speed can naturally be raised to a far higher level by virtue of the fact that the printer of FIGS. 12 and 13 is of the ink jet type.

Moreover, since only one printing head 100 is provided, and since the nozzle rows 111, 112, 113, 114 are arranged in a vertical direction, the print head 100 may have a width similar to the width of a conventional mono color print head. Therefore, the overall width of a serial printer constructed in accordance with the present invention need not be enlarged to any considerable extent.

Figure 14:
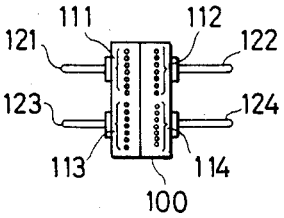
FIG. 14 is a detail view, on an enlarged scale, of a modified print head for a printer such as shown in FIG. 12.

Naturally, the arrangement of the nozzle rows 111, 112, 113, 114 on the print head 100 need not be limited to the arrangement of FIGS. 12 and 13 but, for example, as shown in FIG. 14, the nozzle rows 111, 112, 113, 114 may be grouped into two rows arranged in the vertical direction. By virtue of the arrangement of the nozzle rows 111, 112, 113, 114, in the manner shown in FIG. 14, two lines may be advantageously simultaneously printed in two colors for each line merely by moving the carrier 3 (FIG. 12) once from the left to the right or vice versa.

It is also possible in accordance with the present invention to apply the principles thereof to a heat sensitive printer wherein, for example, the wire dot type printer described hereinabove in connection with FIGS. 1–11, is replaced by a thermal transfer type print head which includes thermal elements in place of the wires and an ink ribbon capable of heat senstitive transfer. In all other respects a thermal transfer type printer would function in the manner described hereinabove; therefore, a further specific description of the thermal transfer type printer is considered unnecessary.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A serial printer comprising a dot type print head means including a plurality of individual printing means adapted to be selectively operated to print information on a medium, said individual printing means being arranged on the print head in a plurality of individual groups corresponding to a width of a print line so as to enable a simultaneous printing of a plurality of print lines, carrier means facing the medium and mounted for displacement in a direction of the print line for carrying the print head means, a ribbon means including a plurality of individual tracks respectively associated with the individual groups of printing means so as to enable a printing of the information by the respective printing means, means for mounting the ribbon means on said carrier means, and means for adjusting a position of the ribbon means with respect to the print head means to change the association of the tracks of the ribbon means with respect to the individual groups of printing means by changing an angle between a direction along a length of the ribbon means and a direction of the print line, and wherein each of said individual groups of printing means are inclined at a predetermined acute angle with respect to a moving direction of said carrier means.

2. A serial printer according to claim 1, wherein means are provided for enabling said individual groups of printing means to print information on the medium in different colors.

3. A serial printer according to claim 1, wherein said individual tracks are of different colors, said ink tracks being respectively positioned so as to correspond to said individual groups of printing means, and said means for mounting the ribbon means includes cassette means mounted on said carrier means for accommodating and guiding at least a portion of said ribbon means.

4. A serial printer according to claim 3 wherein said means for adjusting a position of the ribbon means is adapted to rotate said cassette means so as to enable an adjustment of the tracks of said ribbon means with respect to said print head means.

5. A serial printer according to claim 4, wherein each of the printing means includes a wire means adapted to be selectively actuated so as to print the information on the medium.

6. A serial printer according to claim 1, wherein each of said printing means includes a wire means adapted to be selectively activated so as to print the information on the medium.

7. A serial printer according to claim 1, wherein each of said printing means includes a heat transfer element adapted to cooperate with a heat sensitive ribbon means so as to enable a printing of the information on the medium.

8. A serial printer according to claim 1, wherein the printing means in each of said groups are disposed in substantial alignment with each other so as to form a row of printing means, said rows being vertically spaced from one another.

9. A serial printer according to claim 8, wherein the ribbon means includes at least four tracks of different colors whereby in a first position of the ribbon means, the printing means simultaneously prints four different color print lines and in the adjusted position simultaneously prints four print lines of the same color.

10. A serial printer according to claim 8, wherein the ribbon means includes at least eight tracks, at least four of said tracks are of different colors, said ribbon means being mounted on said carrier means such that in a first position of the ribbon means said at least four different color tracks are positioned with respect to the printing means so as to enable the printing means to simultaneously print at least four different color print lines and, in the adjusted position, to simultaneously print print lines in a color of the remaining tracks of the ribbon means.

11. A color serial printer comprising a platen means for carrying a medium upon which information is to be printed, ink ribbon means including a plurality of tracks of different color, cassette means for at least partly guiding said ink ribbon and partly accommodating a major portion thereof, carrier means displacably mounted for movement in a direction substantially parallel to said platen means, means for mounting said cassette means on said carrier means, and a print head means including a plurality of rows of groups of printing means arranged in such a manner that the respective rows are disposed so as to be associated with the respective tracks of ink ribbon, wherein said means for mounting the cassette means on said carrier means permits said cassette means to be selectively rotatable from a first position in which the rows of printing means are associated with the respective tracks of the ink ribbon means to a second position wherein all of the plurality of rows of said printing means are associated with a common track of said ribbon means.

12. A color serial printer according to claim 11, wherein each of said printing means includes a wire means adapted to be selectively actuated so as to print the information on the medium, and wherein the rows of printing means are inclined at a predetermined acute angle with respect to a moving direction of said carrier means.

* * * * *